US008662656B2

(12) United States Patent
Hanson et al.

(10) Patent No.: US 8,662,656 B2
(45) **Date of Patent: *Mar. 4, 2014**

(54) INKJET WEB PRINTER AND DUPLEX WEB PRINTING PATH

(75) Inventors: Spencer Hanson, Escondido, CA (US); Thomas Tarnacki, San Diego, CA (US); Paul Ray, Maple Grove, MN (US); Stephen W Bauer, San Diego, CA (US); Sean W Dobbins, San Diego, CA (US); Jaren D Marler, Escondido, CA (US); Avinoam Halpern, Escondido, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/528,915

(22) Filed: Jun. 21, 2012

(65) Prior Publication Data

US 2012/0256992 A1 Oct. 11, 2012

Related U.S. Application Data

(63) Continuation of application No. 12/558,154, filed on Sep. 11, 2009, now Pat. No. 8,226,224.

(51) Int. Cl.
*B41J 2/01* (2006.01)

(52) U.S. Cl.
USPC ..... 347/102

(58) Field of Classification Search
None
See application file for complete search history.

(56) References Cited

U.S. PATENT DOCUMENTS 5,640,835 A * 6/1997 Muscoplat ..... 53/569
6,659,602 B2 * 12/2003 Izawa et al. ..... 347/102

* cited by examiner

*Primary Examiner* — Stephen Meier
*Assistant Examiner* — Tracey McMillion
(74) *Attorney, Agent, or Firm* — Steven R. Ormiston

(57) ABSTRACT

In one embodiment, an inkjet printer includes: a first series of print bars arranged along an arc on a first side of an arched printing unit and a second series of print bars arranged along an arc on a second side of the arched printing unit and a dryer positioned within a footprint of the arched printing unit. A plurality of web guides are arranged to guide the web along a duplex printing path past the first print bars for printing on a first side of the web, then through the dryer for drying the first side of the web, then past the second print bars for printing on a second side of the web, and then through the dryer for drying the second side of the web.

18 Claims, 6 Drawing Sheets

INKJET WEB PRINTER AND DUPLEX WEB PRINTING PATH

CROSS REFERENCE TO RELATED APPLICATIONS

This is a continuation of and claims priority from U.S. patent application Ser. No. 12/558,154 filed Sep. 11, 2009 now U.S. Pat. No. 8,226,224, entitled Inkjet Web Printer.

BACKGROUND

Digital inkjet web printers, commonly referred to as inkjet web presses, are now commercially available for industrial and commercial printing. Hewlett-Packard Company, for example, recently released the HP Inkjet Web Press for high production commercial inkjet printing. In the HP Inkjet Web Press, the first side of the web is printed and dried at a first printing station, the web is inverted, and then the second side is printed and dried at a second printing station positioned end-to-end with the first printing station. It may be desirable for some inkjet web press printing applications or environments to minimize the floor space occupied by the press (i.e., the "footprint" of the press). One way to minimize the footprint of an inkjet web press is to stack the printing units vertically at a single printing station as shown and described in U.S. Pat. No. 6,659,602. One disadvantage of a vertical stack press such as that shown in the '602 patent is the difficulty gaining access to each printing unit for servicing. Another disadvantage is that the flat web path past the inkjet print bars in each printing unit in a vertical stack press makes it more difficult to control the web in the printing zone.

DRAWINGS

The same part numbers designate the same or similar parts throughout the figures.

DESCRIPTION

Embodiments of the present disclosure are directed to a smaller footprint inkjet web press. Embodiments of the new web press, described below, offer high quality, duplex web printing while avoiding the disadvantages of a vertical stack web press. The following description, however, should not be construed to limit the scope of the disclosure, which is defined in the claims that follow the description.

As used in this document: "footprint" means the area covered by a part; "print bar" means one or more inkjet pens or other inkjet printhead units for dispensing ink drops across a web; and "web" means a continuous sheet of printable media.

Figure 1:
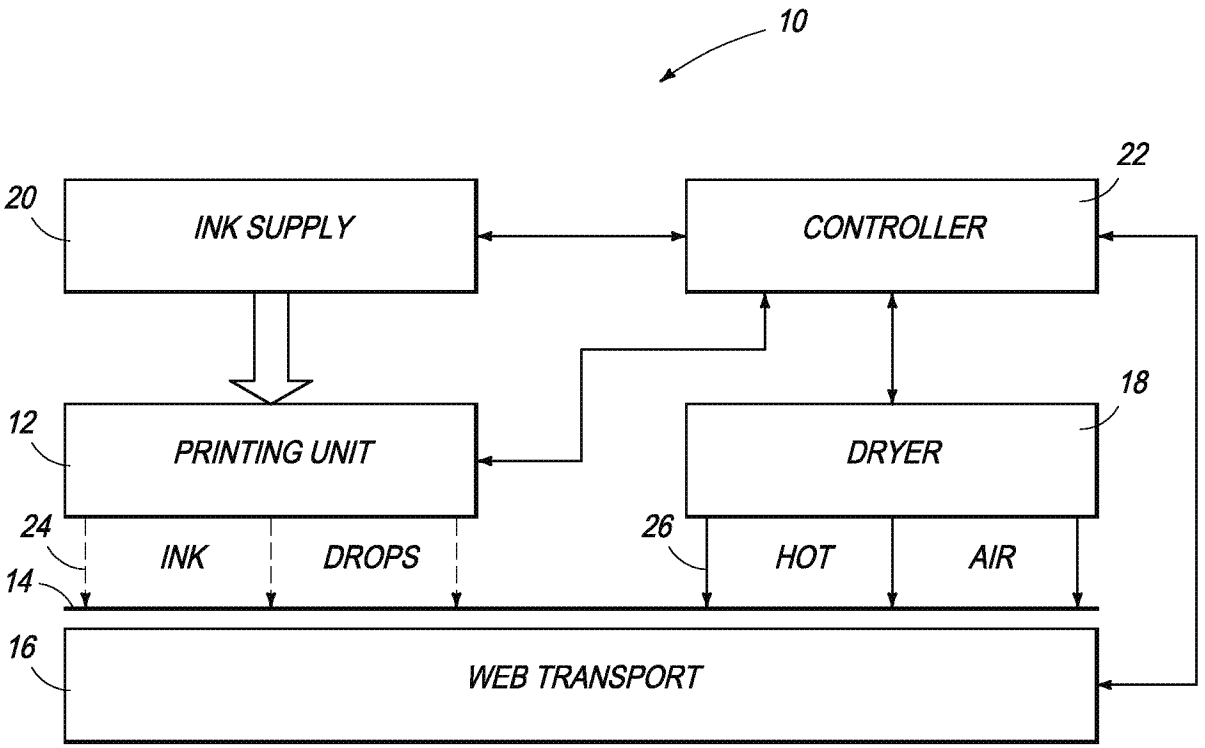
FIG. 1 is a block diagram illustrating one embodiment of an inkjet web printer.

FIG. 1 is a block diagram illustrating one embodiment of an inkjet printer 10 that includes a printing unit 12 spanning the width of a web 14, a media transport mechanism 16, a dryer 18, an ink supply 20, and an electronic controller 22. As described in more detail below with reference to FIGS. 2 and 3, printing unit 12 may include a series of print bars arranged in an arch with each print bar containing, for example, an array of ink pens each carrying one or more printhead dies and the associated mechanical and electrical components for dispensing ink drops 24 on to web 14. Also as described in more detail below with reference to FIGS. 2 and 3, dryer 18 may include, for example, a series of perforated tubes for directing hot air 26 onto web 14. Controller 22 represents generally the programming, processors and associated memories, and the electronic circuitry and components needed to control the operative elements of a printer 10. Due to the massive amount of data and signal processing needed in an inkjet web press, controller 22 may include servers and computer work stations as well as central processing units (CPUs) and associated memories (RAM and hard drives for example) and application specific integrated circuits (ASICs).

Figure 2:
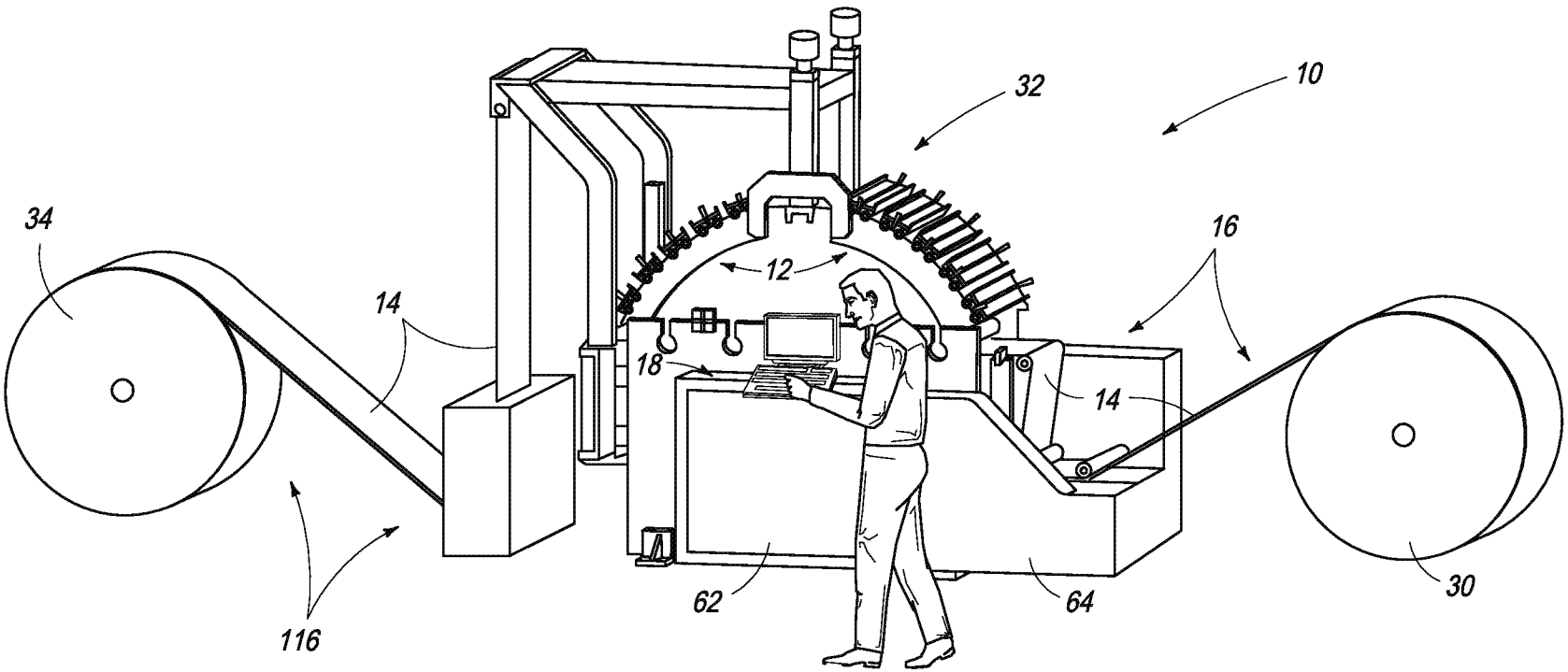
FIG. 2 is a perspective view illustrating a single station inkjet web printer according to one embodiment of the disclosure.
Figure 3:
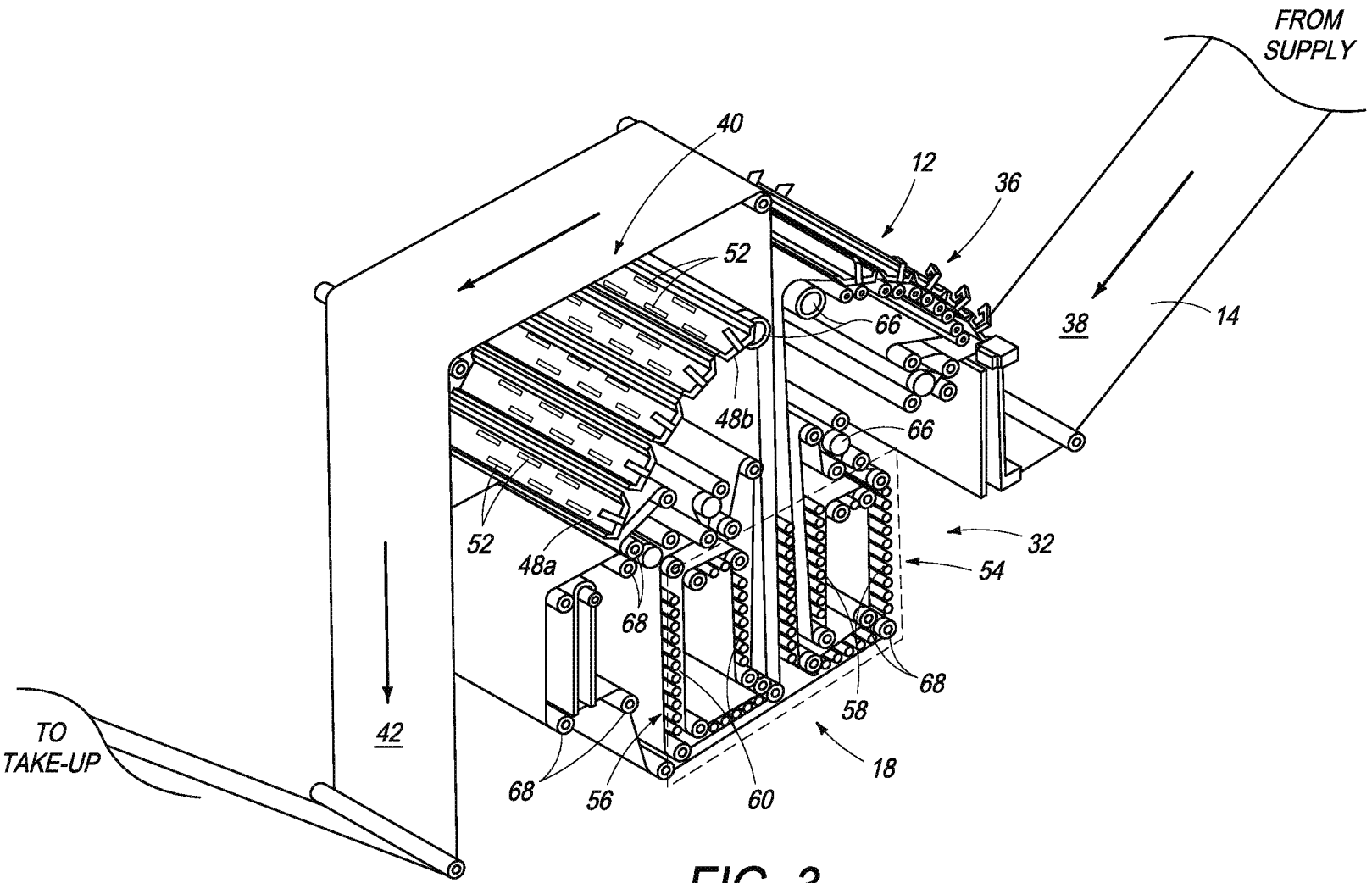
FIG. 3 is a perspective view showing in more detail one embodiment of an arched printing station and duplex web printing path in the printer shown in FIG. 2.
Figure 4:
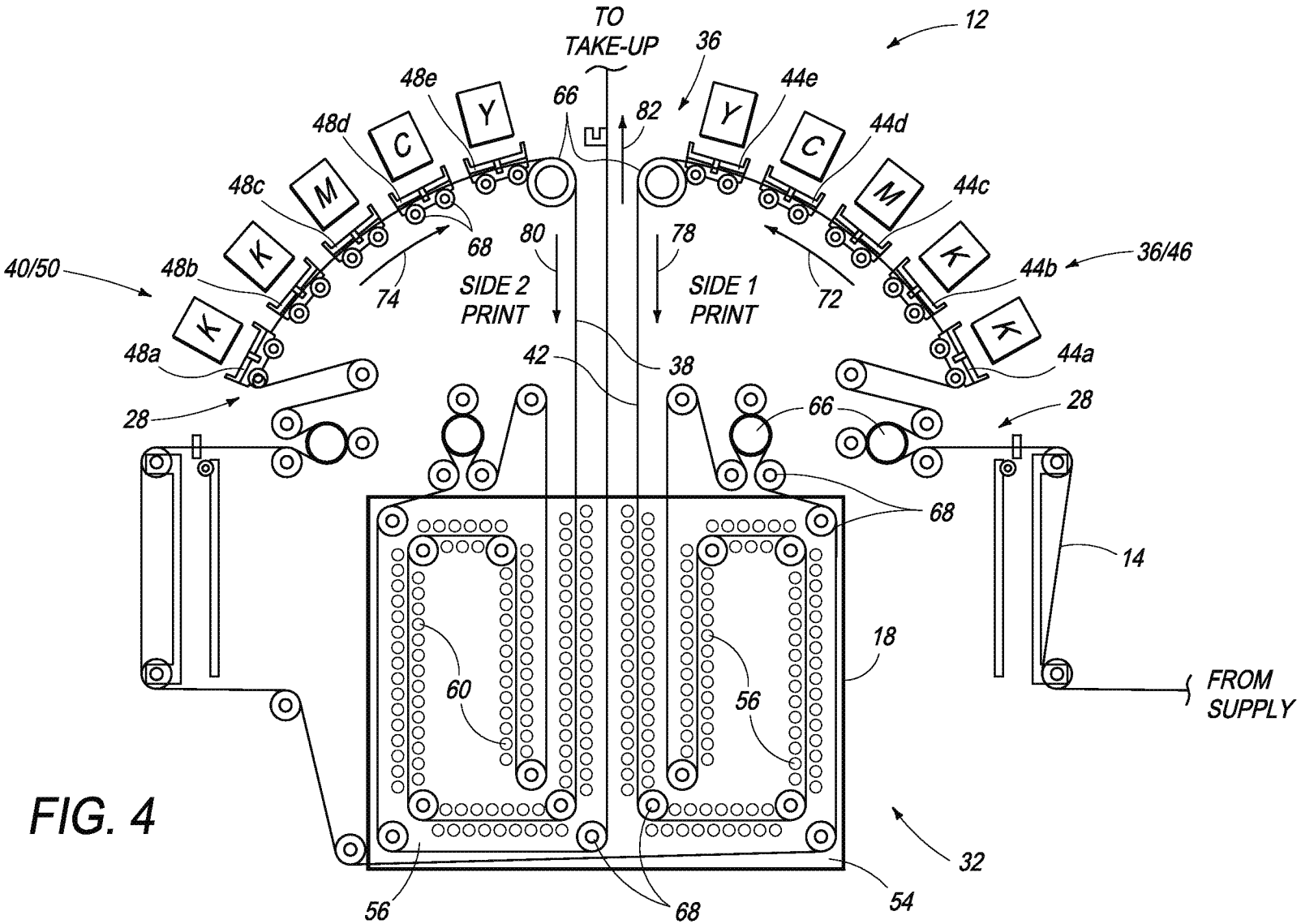
FIGS. 4 and 5 are elevation and perspective views, respectively, illustrating in more detail the duplex web printing path shown in FIG. 3.
Figure 5:
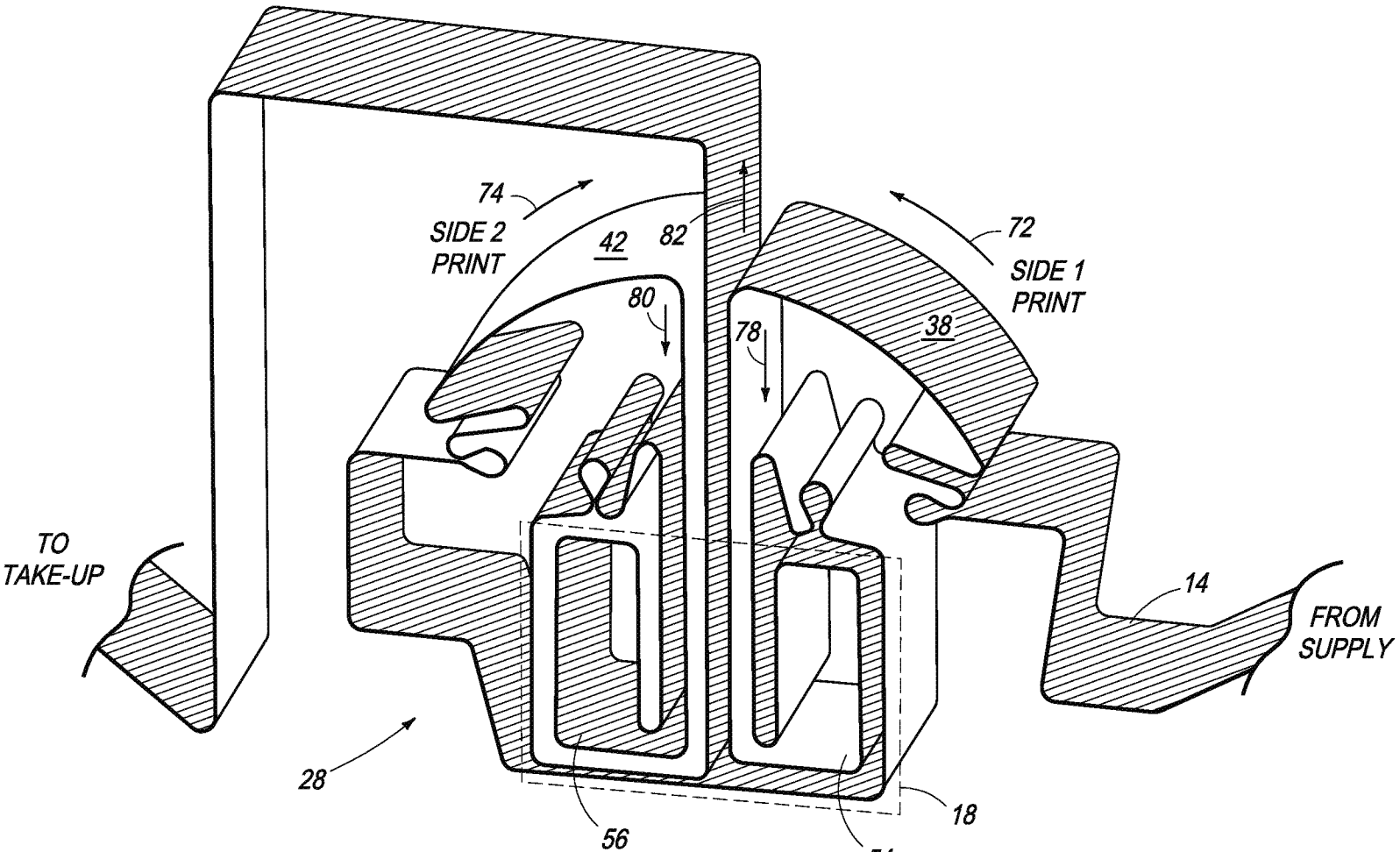

FIG. 2 is a perspective view illustrating a single station inkjet web printer 10 according to one embodiment of the disclosure. FIG. 3 is a perspective view showing in more detail an arched printing unit 12 and a duplex web printing path 28 in the embodiment of printer 10 shown in FIG. 2. FIGS. 4 and 5 are elevation and perspective views, respectively, illustrating duplex printing path 28 in more detail. Referring first to FIG. 2, printer 10 includes a web supply spool 30 from which web 14 is fed to a printing station 32 and a take-up spool 34 onto which web 14 is wound after passing through printing station 32. Referring now also to FIGS. 3-5, printing station 32 includes arched printing unit 12 and a dryer 18 positioned under and contained within the footprint of arched printing unit 12. Arched printing unit 12 includes a first printing part 36 for printing on a first side 38 of web 14 and a second printing part 40 for printing on a second side 42 of web 14, when web 14 is fed along duplex printing path 28.

First printing part 36 includes a first series of print bars 44*a*-44*e* arranged along an arc on a first side 46 of arched printing unit 12. Second printing part 40 includes a second series of print bars 48*a*-48*e* arranged along an arc on a second side 50 of arched printing unit 12. In one example arrangement, shown in FIG. 4, print bars 44*a*, 44*b*, 48*a* and 48*b* dispense black (K) ink, print bars 44*c* and 48*c* dispense magenta (M) ink, print bars 44*d* and 48*d* dispense cyan (C) ink, and print bars 44*e* and 48*e* dispense yellow (Y) ink. In the embodiment shown in FIGS. 2 and 3, each print bar 44, 48 includes a group of ink pens 52. (Ink pens are sometimes also commonly referred to as ink cartridges or printheads.) Ink pens 52 in each print bar 44, 48 are staggered in a lengthwise direction along web 14 and overlap adjacent pens in a crosswise direction across the width of web 14. The configuration of ink pens 52 on each print bar 44, 48 shown in FIGS. 2-3 is just one example. Other configurations are possible. For other examples, each print bar 44, 48 may include a more linear array of printhead dies or one or more printhead modules each holding multiple printhead dies.

Dryer 18 includes a first dryer part 54 for drying web first side 38 and a second dryer part 56 for drying web second side 42. Dryer first part 54 includes a first group of perforated tubes 58 extending across the width of web 14 for directing heated air simultaneously on to both sides 38 and 42 uniformly across the width of web 14. Similarly, dryer second part 56 includes a second group of perforated tubes 60 extending across the width of web 14 for directing heated air simultaneously on to both sides 38 and 42 uniformly across the width of web 14. Some tubes 58 and 60 are omitted from FIG. 3 so as not to unduly obscure web 14 in dryer 18. All of tubes 58 and 60 are shown in FIG. 4. Any suitable perforation(s) in tubes 58 and 60 may be used including, for example, a single lengthwise slit or a pattern of multiple opening. Heated air is pumped into perforated tubes 58, 60, for example, from a source (not shown) that may be integrated into dryer 18 or external to dryer 18. Dryer 18 may be enclosed in a housing 62 (FIG. 2) and air removed from housing 62 through exhaust ducting 64 (FIG. 2).

Although it may be adequate for some printing applications to distribute drying air across only one side 38 or 42, a two sided air drying configuration such as that shown in FIGS. 3-5 has significant advantages. Unlike the drum dryers in the '602 patent noted above in the Background, air drying allows both sides 38 and 42 of web 14 to be exposed to the heating element (heated air in this case) simultaneously to help speed drying. Also, applying air to both sides 38 and 42 simultaneously helps support web 14 along the spans between web guides. In the embodiment shown in FIGS. 3-5, web path 28 includes three vertical spans and two horizontal spans through air distribution tubes 58, 60 in each dryer part 54 and 56. Other configurations are possible, for example depending on the size of dryer 18 and the drying capacity of air distribution tubes 58 and 60 (and any other drying elements that might be used).

Referring still to FIGS. 2-5, a series of guide rollers 66 and 68 are arranged to guide web 14 along duplex printing path 28 from supply spool 30 past first print bars 44*a*-44*e* for printing on web first side 38, then through first dryer part 54 for drying web first side 38, then past second print bars 48*a*-48*e* for printing on web second side 42, then through second dryer part 56 for drying web second side 42, and then to take-up spool 34. In the embodiment shown, web guides 66 are driven rollers that also help move web 14 along path 28, and web guides 68 are non-driven rollers (e.g. idler rollers). Web guides 66 and 68 are arranged to contact only second side 42 of web 14 in dryer first part 54 and only first side 38 of web 14 in dryer second part 56.

Unlike conventional web presses that use a turn bar to invert the web for duplex printing, in duplex printing path 28 the long axis of each web guide 66, 68 is oriented parallel to the long axis of each of the other web guides 66, 68. Web 14 moves past first print bars 44*a*-44*e* along a rising arc in one direction, as indicated by arrows 72 in FIGS. 4 and 5, and past second print bars 48*a*-48*e* also along a rising arc but in the opposite direction, as indicated by arrows 74 in FIGS. 4 and 5. Thus, there is no need to invert web 14 on a turn bar for duplex printing, while still realizing the benefits of a smaller footprint, arched printing unit 12. Also, as best seen in FIGS. 4 and 5, web 14 travels vertically down to dryer 18 from both printing parts 36 and 40 along a center part 76 of arched printing unit 12 between first printing part 36 and second printing part 40, as indicated by arrows 78 and 80. Web 14 exits printing station 32 in the opposite direction (vertically upward) along this same line as indicated by arrow 82. Thus, a dryer 18 for drying both sides 38 and 42 of web 14 may be fully contained within the footprint of arched printing unit 12.

Another advantage of the new duplex printing path 28 and arched printing station 32 is the ease with which printing unit 12 and dryer 18 may be accessed for service. Full access to print bars 44 and 48, web path 28 and dryer 18 may be gained simply by removing housing covers on the front and/or back sides of printing station 32. Also, the tension in web 14 and its alignment to print bars 44, 48 is much easier to control along an arced web path 28 (at arrows 72, 74 in FIG. 4) than the flat web path in the vertical stack press shown in the '602 patent noted above in the Background. Printing along an arc gives a stable wrap angle around each print zone guide idler roller 68 for consist high-speed printing. The web wrap on print zone guide rollers 66 has several advantages, including (1) to help ensure that web 14 rotates each idler roller 68 instead of web 14 dragging across the roller, which could damage the side of web 14 in contact rollers 66 particularly where an image has been formed on the contact side of web 14, (2) to minimize air entrainment between web 14 and print zone idler rollers 66, which could destabilize web 14 and misalign the printed image, and (3) to reduce the risk of a cackled web 14 crashing into a print bar 44, 48 or an ink pen 52.

Figure 6:
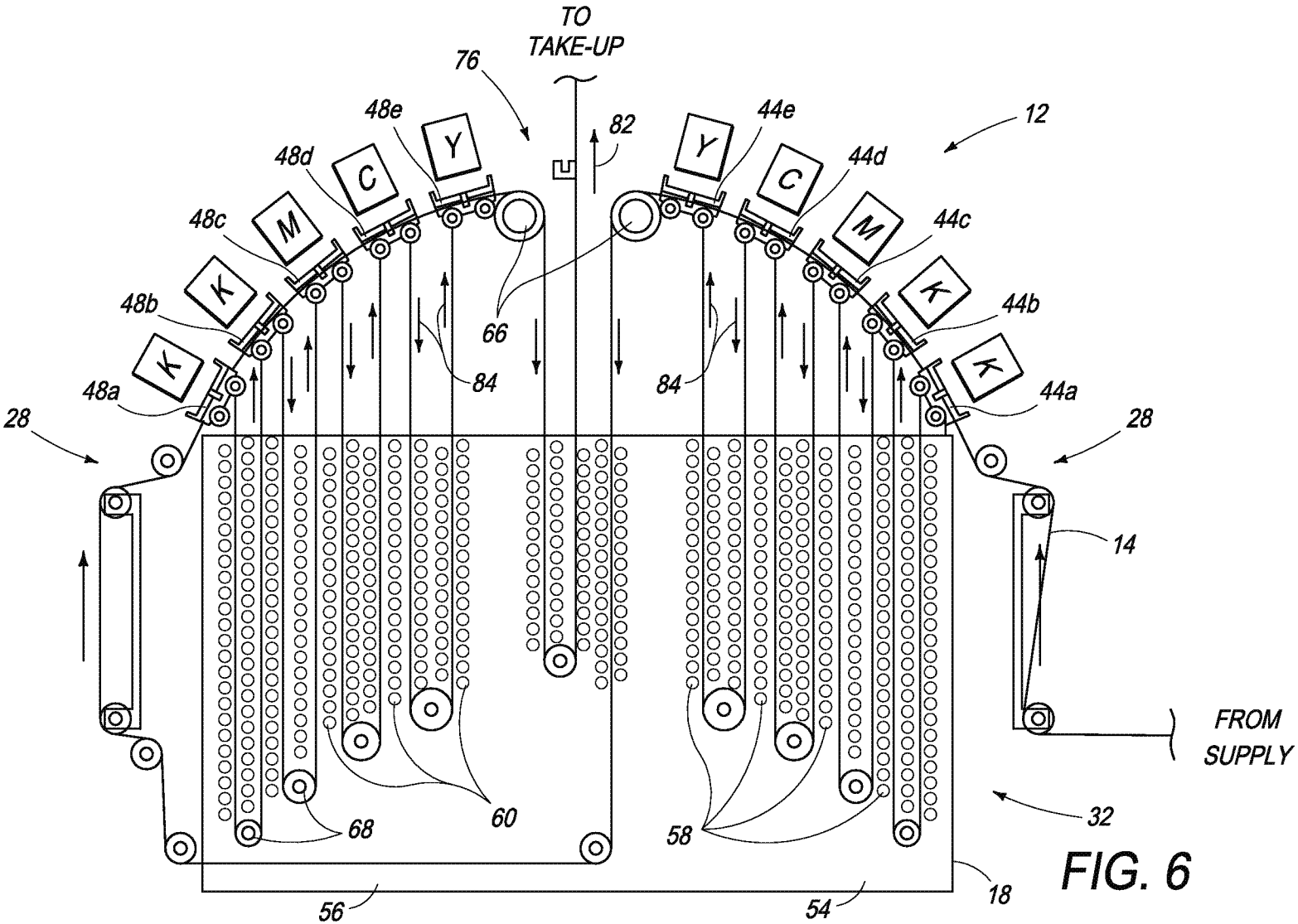
FIG. 6 is an elevation view of one embodiment of a duplex web printing path through the printer shown in FIG. 2 with interstitial drying in which the web moves through the dryer after passing each print bar.

Another advantage of the new duplex printing path 28 and arched printing station 32 is the enablement of interstitial drying within the same compact footprint. FIG. 6 is an elevation view of one embodiment of a duplex web printing path 28 with interstitial drying, in which web 14 moves through dryer 18 after passing each print bar 44*a*-44*e* and 48*a*-48*e*. An interstitial drying web path 28 as in FIG. 6 allows immediately drying the ink printed at each print bar which, for example, can help achieve higher quality printing on less expensive non-porous or closed web media. Referring to FIG. 6, web guides 66 and 68 are arranged to guide web 14 down to dryer 18 after passing each print bar 44*a*-44*e* and 48*a*-48*e* and then back up to printing unit 12 past the next print bar 44*a*-44*e* and 48*a*-48*e*, as indicated by arrows 84.

As in the previous embodiment, air distribution tubes 58 and 60 are arranged along both sides of web 14 in dryer parts 52 and 54. The air support of web 14 afforded by opposing tubes 58, 60 may be particularly advantageous for interstitial drying to allow for longer spans of web 14 between web guides 66, 68. In other embodiments, it may be desirable to guide web 14 past more than one print bar 44*a*-44*e*, 48*a*-48*e* before drying. Indeed, a number of different configurations for web path 28 are possible without changing the structural configuration of print station 32 by threading web 14 into the desired path. For one example, web 14 could be threaded past both black (K) print bars 44*a*, 44*b* and 48*a*, 48*b* and down to dryer 18, and then past each of the other print bars 44*c*-44*e* and 48*c*-48*e* and down to dryer 18 in succession 6.

As noted at the beginning of this Description, the exemplary embodiments shown in the figures and described above illustrate but do not limit the invention. Other forms, details, and embodiments may be made and implemented. Therefore, the foregoing description should not be construed to limit the scope of the invention, which is defined in the following claims.

What is claimed is:

1. An inkjet printer, comprising:

an arched printing unit having a first series of print bars arranged along an arc on a first side of the arched printing unit and a second series of print bars arranged along an arc on a second side of the arched printing unit;

a dryer positioned within a footprint of the arched printing unit; and a plurality of web guides arranged to guide the web along a duplex printing path past the first series of print bars for printing on a first side of the web, then through the dryer for drying the first side of the web, then past the second series of print bars for printing on a second side of the web, and then through the dryer for drying the second side of the web.

2. The printer of claim 1, wherein the web guides are arranged to guide the web along the duplex printing path past the first series of print bars along an arc in a first direction and past the second series of print bars along an arc in a second direction opposite the first direction.

3. The printer of claim 2, wherein the web guides are arranged to guide the web along the duplex web printing path from the first series of print bars to the dryer in a third direction along a center part of the arched printing unit, from the second series of print bars to the dryer in the third direction along the center part of the arched printing unit, and from the dryer out of the arched printing unit in a fourth direction opposite the third direction along the center part of the arched printing unit.

4. The printer of claim 1, wherein the dryer is configured to direct heated air simultaneously onto both the first side of the web and the second side of the web.

5. The printer of claim 4, wherein the dryer configured to direct heated air simultaneously onto both the first side of the web and the second side of the web comprises the dryer configured to direct heated air simultaneously across the full width of both the first side of the web and the second side of the web.

6. The printer of claim 1, wherein:

the dryer includes a first dryer part positioned under the first side of the arched printing unit and a second dryer part positioned under the second side of the arched printing unit; and the web guides are arranged to guide the web along a duplex printing path past the first series of print bars for printing on a first side of the web, then through the first dryer part for drying the first side of the web, then past the second series of print bars for printing on a second side of the web, and then through the second dryer part for drying the second side of the web.

7. The printer of claim 6, wherein the first dryer part is configured to direct heated air simultaneously onto both the first side of the web and the second side of the web and the second dryer part is configured to direct heated air simultaneously onto both the first side of the web and the second side of the web.

8. The printer of claim 7, wherein:

the first dryer part configured to direct heated air simultaneously onto both the first side of the web and the second side of the web comprises a first group of perforated tubes positioned along both sides of the duplex printing path in the first part of the dryer; and the second dryer part configured to direct heated air simultaneously onto both the first side of the web and the second side of the web comprises a second group of perforated tubes positioned along both sides of the duplex printing path in the second part of the dryer.

9. The printer of claim 6, wherein the web guides are arranged to contact only the second side of the web in the first part of the dryer and only the first side of the web in the second part of the dryer.

10. The printer of claim 1, wherein some or all of the web guides comprise rollers.

11. An inkjet printer, comprising:

an arched printing unit having first print bars arranged along an arc on a first side of the arched printing unit and second print bars arranged along an arc on a second side of the arched printing unit;

a dryer positioned within a footprint of the arched printing unit, the dryer having a first dryer part positioned under the first side of the arched printing unit and a second dryer part positioned under the second side of the arched printing unit; and a plurality of web guides arranged to guide the web along a duplex printing path:

past a first one or more the first print bars for printing on a first side of the web;

then through the first dryer part for drying of the first side of the web;

then past a second one or more of the first print bars for more printing on the first side of the web;

then through the first dryer part for more drying of the first side of the web;

then past a first one or more of the second print bars for printing on a second side of the web;

then through the second dryer part for drying of the second side of the web;

then past a second one or more of the second print bars for more printing on the second side of the web; and then through the second dryer part for more drying of the second side of the web.

12. The printer of claim 11, wherein the web guides are arranged to guide the web along the duplex printing path through the corresponding dryer part after passing each print bar.

13. The printer of claim 11, wherein the web guides are arranged to guide the web along the duplex printing path:

past the first print bars along an arc in a first direction and past the second print bars along an arc in a second direction opposite the first direction; and from the first print bars to the dryer in a third direction along a center part of the arched printing unit, from the second print bars to the dryer in the third direction along the center part of the arched printing unit, and from the dryer out of the arched printing unit in a fourth direction opposite the third direction along the center part of the arched printing unit.

14. The printer of claim 11, wherein the first dryer part is configured to direct heated air simultaneously onto both the first side of the web and the second side of the web and the second dryer part is configured to direct heated air simultaneously onto both the first side of the web and the second side of the web.

15. A duplex web printing path, comprising:

a first quadri-circular arced printing zone in which a first side of the web is exposed to first printing elements;

a first drying zone downstream from the first arced printing zone in which the web is exposed to first drying elements;

a second quadri-circular arced printing zone in which a second side of the web is exposed to second printing elements, the second arced printing zone located near the first arced printing zone such that the two printing zones together form a semi-circle; and a second drying zone downstream from the second arced printing zone in which of the web is exposed to second drying elements.

16. The printing path of claim 15, wherein the first drying zone and the second drying zone are both positioned within a footprint of the arced printing zones.

17. The printer of claim 1, wherein:

the arched printing comprises a single, semi-circular arched printing unit;

the first series of print bars is arranged along an arc on a quadri-circular first side of the arched printing unit; and the second series of print bars is arranged along an arc on a quadri-circular second side of the arched printing unit.

18. The printer of claim 11, wherein:

the arched printing unit comprises a single, semi-circular arched printing unit;

the first print bars are arranged along an arc on a quadri-circular first side of the arched printing unit; and the second print bars are arranged along an arc on a quadri-circular second side of the arched printing unit.

* * * * *

UNITED STATES PATENT AND TRADEMARK OFFICE

CERTIFICATE OF CORRECTION

PATENT NO. : 8,662,656 B2
APPLICATION NO. : 13/528915
DATED : March 4, 2014
INVENTOR(S) : Spencer Hanson et al.

It is certified that error appears in the above-identified patent and that said Letters Patent is hereby corrected as shown below:

In the Claims:

In column 5, line 66, in Claim 11, after “more” insert -- of --.

In column 6, line 51, in Claim 15, after “which” delete “of”.

Signed and Sealed this
Fifth Day of August, 2014

Michelle K. Lee

Michelle K. Lee
*Deputy Director of the United States Patent and Trademark Office*